US011785404B2

(12) United States Patent
Guo et al.

(10) Patent No.: US 11,785,404 B2
(45) Date of Patent: Oct. 10, 2023

(54) METHOD AND SYSTEM OF FITTING A HEARING DEVICE

(71) Applicant: Oticon A/S, Smørum (DK)

(72) Inventors: Meng Guo, Smørum (DK); Bernhard Kuenzle, Düdingen (CH)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 17/708,467

(22) Filed: Mar. 30, 2022

(65) Prior Publication Data

US 2022/0322019 A1 Oct. 6, 2022

(30) Foreign Application Priority Data

Mar. 31, 2021 (EP) ..... 21166135
Jun. 23, 2021 (EP) ..... 21181031

(51) Int. Cl.
*H04R 25/00* (2006.01)

(52) U.S. Cl.
CPC ..... *H04R 25/70* (2013.01); *H04R 25/453* (2013.01); *H04R 25/505* (2013.01); *H04R 2225/55* (2013.01)

(58) Field of Classification Search
CPC .... H04R 25/70; H04R 25/453; H04R 25/505; H04R 2225/55; H04R 25/558; H04R 3/02; H04R 1/1091; H04R 2460/07; H04R 25/507; H04R 2225/43
See application file for complete search history.

(56) References Cited

U.S. PATENT DOCUMENTS 9,439,009 B2 * 9/2016 Kim ..... H04R 25/70
10,966,038 B2 * 3/2021 Callaway ..... H04R 25/453
2014/0148724 A1 5/2014 Ungstrup et al.
2019/0253817 A1 8/2019 Callaway et al.

FOREIGN PATENT DOCUMENTS

WO WO 2020/051593 A1 3/2020

OTHER PUBLICATIONS

EP 3 493 555 B1. De Vries, Aalbert. Hearing Device and Method for Tuning Hearing Device Parameters. (Year: 2022).*

* cited by examiner

*Primary Examiner* — Brian Ensey
(74) *Attorney, Agent, or Firm* — Birch, Stewart, Kolasch & Birch, LLP

(57) ABSTRACT

In a method of fitting of a hearing device having an input transducer and an output transducer, the method includes executing a fitting application on a graphical user interface of an external device in communication with the hearing device, detecting by measuring reactions of the user to picked-up sound, performing acoustic feedback measurements as a background process without a user's involvement, assessing the probability of a correct physical fit based on the position of the inserted hearing device, assessing feedback risk based on the correct physical fit assessment and the acoustic feedback measurements, and fine tuning fitting parameter of the hearing device based on the result of at least one of the detected reactions of the user, acoustic feedback measurements and saved, within the fitting application, personal information of the user.

20 Claims, 6 Drawing Sheets

METHOD AND SYSTEM OF FITTING A HEARING DEVICE

SUMMARY

The present disclosure relates to fitting of a hearing device without guidance of a hearing care professional (HCP) and/or to self-fitting of a hearing device, e.g., a hearing aid, to a user's particular needs.

Today, a hearing aid user will experience feedback whenever the hearing aid fitting is not within specific tolerances. Any hearing aid with moderate to high gain has the probable biproduct of acoustic feedback. An HCP must pay careful attention to this feedback, so that the hearing aid user will not experience it. It requires the HCP to test for feedback with a variety of methods, which are time consuming: For example, running special feedback management tests or manually testing for feedback.

It would be advantageous to have a quicker and natural way of fitting hearing devices.

The present application describes a method/process/procedure (in the following referred to as 'the method') and a system that allows a hearing aid fitting to proceed without requiring the HCP, unless necessary. The user will be notified if there is a high risk of feedback. If this is the case, appropriate warnings, and/or recommended feedback preventive actions are provided to the user, or automatically implemented by the hearing system.

In an aspect, a method of fitting of a hearing device without a Hearing care professional's (HCP) involvement is provided. The hearing device comprises an input transducer for picking up sound in the environment of a user and providing an electric input signal, and an output transducer for providing output stimuli perceivable to the user as sound based on a processed version of the electric input signal. The method comprising the steps of executing a fitting application on a graphical user interface, GUI, of an external device in communication with the hearing device, detecting by measuring reactions of the user to the picked-up sound, performing acoustic feedback measurements as a background process without a user's involvement, assessing the probability of a correct physical fit based on the position of the inserted hearing device, assessing feedback risk based on the correct physical fit assessment and the acoustic feedback measurements and fine tuning fitting parameter of the hearing device based on the result of at least one of the detected reactions of the user, acoustic feedback measurements and saved, within the fitting application, personal information of the user, wherein steps are configured to be automatically performed as background processes.

In an aspect, the step of detecting by measuring reactions comprises performing a hearing test, within the fitting application, for estimating a hearing ability of a user of the hearing device.

In an aspect, the step of performing a hearing test comprises obtaining a neural response to the hearing test by a sensor of the hearing device, providing a sensor output based on the neural response, estimating hearing ability of the user based on the sensor output and the microphone output of the hearing device, and wherein the fine-tuning fitting parameter of the hearing device is based on the estimated hearing ability.

In an aspect, the method comprises the steps of presenting, within the fitting application, a hearing device model based on the result of the performed hearing test application and saved, within the fitting application, personal information of the user, instructing the user, within the fitting application, how to position the presented hearing device model in the ear of the user, and obtaining an image of the ear region including the inserted hearing device by using a camera unit of the external device.

In an aspect, the step of assessment of the probability of correct physical fit comprises, if the assessment provides a positive result, informing the user, via the fitting application, of correct physical fit of the hearing device, or if the assessment provides a negative result, informing the user, via the fitting application, of incorrect physical fit of the hearing device and instruct user to adjust hearing device.

In an aspect the method comprises the step of automatically, if the assessment of feedback risk provides a negative result which is based on an acoustic feedback and/or gain problem, mitigating the assessed problem based on predefined strategies.

In an aspect, the method comprises the steps of, if the assessment of feedback risk provides a negative result which is based on an acoustic feedback and/or gain problem, informing the user, within the fitting application, of the problem, and providing instructions to the user, within the fitting application, of how to mitigate the problem.

In an aspect, the step of assessing the probability of a correct physical fit comprises applying a learning machine for assessing the probability of a correct physical fit.

In an aspect, the step of assessing feedback risk comprising applying a learning machine for assessing the feedback risk.

In an aspect, the step of applying a learning machine comprises collecting personal data and corresponding fitting data and saving in a central database, and using artificial intelligence, AI, for training a model for fitting the hearing device to the user's hearing abilities.

In an aspect, the hearing device is constituted by or comprises a hearing aid.

In an aspect, a hearing system comprising a hearing device adapted for being programmed according to detected by measuring of reactions of a hearing device user is provided. The hearing device comprises an input transducer for picking up sound in the environment of the user and providing an electric input signal, an output transducer for providing output stimuli perceivable to the user as sound based on a processed version of said electric input signal, a configurable hearing device processor for processing said electric input signal and providing said processed version of said electric input signal. The hearing system further comprises a graphical user interface, GUT, allowing the user to interact with the hearing device, wherein the hearing system is configured to execute the method as presented above.

In an aspect, the hearing system comprises a communication device comprising a processor for executing program code of a fitting system for the hearing device, and a programming interface between the hearing device and the communication device, wherein the programming interface is configured to allow the exchange of data between the hearing device and the communication device.

In an aspect, the programming interface is configured to establish a wired or wireless communication link between the hearing device and the communication device.

In an aspect, the hearing system wherein said hearing device is constituted by or comprises a hearing aid.

In an aspect, the hearing system is adapted to establish a communication link between the hearing device and an auxiliary device to provide that information (e.g., control and status signals, possibly audio signals) can be exchanged or forwarded from one to the other.

It is intended that some or all of the process features of the method described above, in the 'detailed description of embodiments' or in the claims can be combined with embodiments of the system, when appropriately substituted by a corresponding structural feature and vice versa. Embodiments of the system have the same advantages as the corresponding methods.

In an aspect, a configurable hearing device adapted to allow a user to program it according to a specific hearing device user's needs is provided by the present disclosure. The hearing device comprises a hearing device processor for executing program code, a user interface allowing a user to interact with the hearing device, wherein the program code comprises instructions for implementing the method described above in the 'detailed description of embodiments' and in the claims.

The hearing device be adapted to provide a frequency dependent gain and/or a level dependent compression and/or a transposition (with or without frequency compression) of one or more frequency ranges to one or more other frequency ranges, e.g., to compensate for a hearing impairment of a user. The hearing aid comprise a signal processor for enhancing the input signals and providing a processed output signal.

The hearing device comprise an output unit for providing a stimulus perceived by the user as an acoustic signal based on a processed electric signal. In an embodiment, the output unit comprise an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g., in a bone-attached or bone-anchored hearing aid).

In an embodiment, the hearing aid comprise an input unit for providing an electric input signal representing sound. In an embodiment, the input unit comprise an input transducer, e.g., a microphone, for convening an input sound to an electric input signal. In an embodiment, the input unit comprises a wireless receiver for receiving a wireless signal comprising sound and for providing an electric input signal representing said sound.

In an embodiment, the hearing aid comprises an antenna and transceiver circuitry (e.g., a wireless receiver) for wirelessly receiving a direct electric input signal from another device, e.g., from an entertainment device (e.g., a TV-set), a communication device, a wireless microphone, or another hearing device.

In an embodiment, the communication between the hearing device and the other device is in the base band (audio frequency range, e.g., between 0 and 20 kHz). Preferably, communication between the hearing device and the other device is based on some sort of modulation at frequencies above 100 kHz. Preferably, frequencies used to establish a communication link between the hearing aid and the other device is below 70 GHz, e.g., located in a range from 50 MHz to 70 GHz, e.g., above 300 MHz. e.g., in an ISM range above 300 MHz, e.g., in the 900 MHz range or in the 2.4 GHz range or in the 5.8 GHz range or in the 60 GHz range (ISM=Industrial, Scientific and Mediclab, such standardized ranges being e.g., defined by the International Telecommunication Union, ITU). The wireless link may be based on a standardized or proprietary technology. The wireless link may be based on Bluetooth technology (e.g., Bluetooth Low-Energy technology).

In an embodiment, the hearing device is or form part of a portable (i.e., configured to be wearable) device, e.g., a device comprising a local energy source. e.g., a battery. e.g., a rechargeable battery.

In an embodiment, the hearing device comprises a number of detectors configured to provide status signals relating to a current physical environment of the hearing aid (e.g., the current acoustic environment), and/or to a current state of the user wearing the hearing aid, and/or to a current state or mode of operation of the hearing aid. Alternatively. or additionally, one or more detectors may form part of an external device in communication (e.g., wirelessly) with the hearing device. An external device may e.g., comprise another hearing device, a remote control, and audio delivery device, a telephone (e.g., a smartphone), an external sensor, etc.

In an embodiment, one or more of the number of detectors may operate on the full band signal (time domain). One or more of the number of detectors may operate on band split signals ((time-) frequency domain). e.g., in a limited number of frequency bands.

In one embodiment, the number of detectors may comprise a level detector for estimating a current level of a signal of the forward path. The detector may be configured to decide whether the current level of a signal of the forward path is above or below a given (L-)threshold value. The level detector operates on the full band signal (time domain). The level detector operates on band split signals ((time-) frequency domain).

In an embodiment, the hearing aid may comprise a voice activity detector (VAD) for estimating whether or not (or with what probability) an input signal comprises a voice signal (at a given point in time). A voice signal is in the present context taken to include a speech signal from a human being. It may also include other forms of utterances generated by the human speech system (e.g., singing). The voice activity detector unit is adapted to classify a current acoustic environment of the user as a VOICE or NO-VOICE environment. This has the advantage that time segments of the electric microphone signal comprising human utterances (e.g., speech) in the user's environment can be identified, and thus separated from time segments only (or mainly) comprising other sound sources (e.g., artificially generated noise). The voice activity detector may be adapted to detect as a VOICE also the user's own voice. Alternatively, the voice activity detector may be adapted to exclude a user's own voice from the detection of a VOICE.

In an embodiment, the hearing device comprises an own voice detector for estimating whether or not (or with what probability) a given input sound (e.g., a voice, speech) originates from the voice of the user of the system. In an embodiment, a microphone system of the hearing device may be adapted to be able to differentiate between a user's own voice and another person's voice and possibly from NON-voice sounds.

In an embodiment, the number of detectors may comprise a movement detector, e.g., an acceleration sensor. The movement detector is configured to detect movement of the user's facial muscles and/or bones, e.g., due to speech or chewing (e.g., jaw movement) and to provide a detector signal indicative thereof.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g., including the current electromagnetic environment, e.g., the occurrence of electromagnetic signals (e.g., comprising audio and/or control signals) intended or not intended for reception by the hearing aid, or other properties of the current environment than acoustic), b) the current acoustic situation (input level, feedback, etc.), c) the current mode or state of the user (movement, temperature, cognitive load, etc.).

d) the current mode or state of the hearing aid (program selected, time elapsed since last user interaction, etc.) and/or of another device in communication with the hearing device.

The classification unit may be based on or comprise a neural network, e.g., a rained neural network.

In an embodiment, the hearing device comprises an acoustic (and/or mechanical) feedback suppression system. Adaptive feedback cancellation has the ability to track feedback path changes over time. It is based on a linear time invariant filter to estimate the feedback path, but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the feedback suppression system comprises a feedback estimation unit for providing a feedback signal representative of an estimate of the acoustic feedback path, and a combination unit, e.g., a subtraction unit, for subtracting the feedback signal from a signal of the forward path (e.g., as picked up by an input transducer of the hearing device). In an embodiment, the feedback estimation unit comprises an update part comprising an adaptive algorithm and a variable filter part for filtering an input signal according to variable filter coefficients determined by said adaptive algorithm, wherein the update part is configured to update said filter coefficients of the variable filter part with a configurable update frequency $f_{upd}$.

The update part of the adaptive filter comprises an adaptive algorithm for calculating updated filter coefficients for being transferred to the variable filter part of the adaptive filter. The timing of calculation and/or transfer of updated filter coefficients from the update part to the variable filter part may be controlled by the activation control unit. The timing of the update (e.g., its specific point in time, and/or its update frequency) may preferably be influenced by various properties of the signal of the forward path. The update control scheme is preferably supported by one or more detectors of the hearing aid, preferably included in a predefined criterion comprising the detector signals.

In an embodiment, the hearing device further comprises other relevant functionality for the application in question, e.g., compression, noise reduction, etc.

In an embodiment, the hearing device comprises a listening device, e.g., a hearing aid, e.g., a hearing instrument, e.g., a hearing instrument adapted for being located at the ear or fully or partially in the ear canal of a user, e.g., a headset, an earphone, an ear protection device, or a combination thereof.

In an aspect, a programming device for programming the hearing device according to a specific hearing device user's needs is provided by the present disclosure. The programming device comprises a programming device processor for executing program code, a programming interface allowing the exchange of data between the programming device and the hearing device.

a user interface allowing a user to interact with the programming device and/or the hearing device, wherein the program code comprises instructions for implementing the method described above in the 'detailed description of embodiments' and in the claims.

In a further aspect, a non-transitory application, termed an APP, is furthermore provided by the present disclosure. The APP comprises executable instructions configured to be executed on an auxiliary device to implement a user interface for a hearing aid or a hearing system described above in the 'detailed description of embodiments', and in the claims. The APP is configured to run on cellular phone, e.g., a smartphone, or on another portable device allowing communication with said hearing aid or said hearing system.

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g., be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer. e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device or may be an external unit in itself (possibly in combination with a flexible guiding element, e.g., a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g., processed information, e.g., provided by the signal processing circuit), e.g., for use in connection with an interface to a user and/or an interface to a programming device. In some hearing devices, the output unit may comprise an output transducer, such as e.g., a loudspeaker for providing an air-borne acoustic signal or a vibrator for providing a structure-borne or liquid-borne acoustic signal. In some hearing devices, the output unit may comprise one or more output electrodes for providing electric signals (e.g., a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g., through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g., a hearing aid, may be adapted to a particular user's needs, e.g., a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g., an audiogram, using a fitting rationale (e.g., adapted to speech). The frequency and level dependent gain may e.g., be embodied in processing parameters. e.g., uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g., remote controls, audio gateway devices, mobile phones (e.g., SmartPhones), or music players. Hearing devices, hearing systems or binaural hearing systems may e.g., be used for compensating for a hearing-impaired person's loss of hearing capability, augmenting, or protecting a normal-hearing person's hearing capability and/or conveying electronic audio signals to a person. Hearing devices or hearing systems may e.g., form part of or interact with public-address systems, active ear protection systems, handsfree telephone systems, car audio systems, entertainment (e.g., karaoke) systems, teleconferencing systems, classroom amplification systems, etc.

Embodiments of the disclosure may e.g., be useful in applications such as hearing devices, e.g., hearing aids.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1:
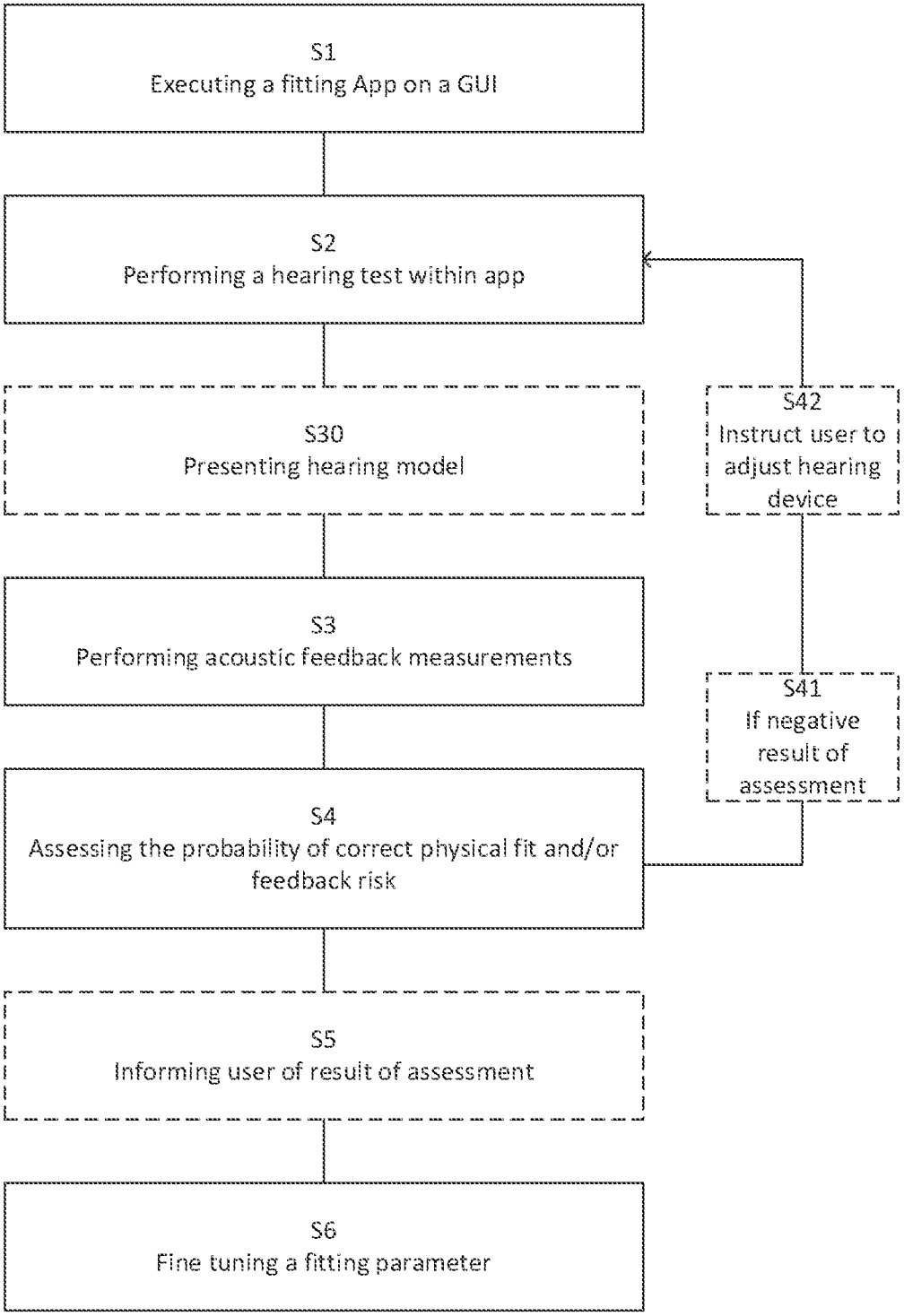
FIG. 1 shows a flowchart of the method according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include micro-electronic-mechanical systems (MEMS), integrated circuits (e.g. application specific), microprocessors, microcontrollers, digital signal processors (DSPs), field programmable gate arrays (FPGAs), programmable logic devices (PLDs), gated logic, discrete hardware circuits, printed circuit boards (PCB) (e.g. flexible PCBs), and other suitable hardware configured to perform the various functionality described throughout this disclosure, e.g. sensors, e.g. for sensing and/or registering physical properties of the environment, the device, the user, etc. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g., hearing aids. The disclosure relates more specifically to two fitting situations, the remote fitting situation, and the self-fitting situation are discussed. In both situations and cases, there are some challenges that need to be addressed compared to the traditional fitting situations where the end users would sit next to a Hearing care professional (HCP).

In a remote fitting situation, the HCP is psychically far away from the end user, but she/he is connected to the end user (through phone, internet etc.) and performs the fitting from the remote. This method is in use today, although typically not for the first fitting session, but for the follow up sessions.

In a self-fitting situation, there is no involvement of an HCP at all. The end user is supposed to carry out the fitting session on his/her own, based on some predefined procedures/guidelines from the hearing aid manufacturer. At the current time, this method is in for some simple self-fitting procedures that are available for earbuds applications but not for high-end and dedicated hearing aids.

In both fitting situations, an enhanced and improved fitting procedure or method is provided to obtain an optimal fitting of the hearing device and to make the fitting easy to carry out for the end user during these two fitting situations.

Hearing Test

A traditional hearing test is carried out in a sound box, where the HCP/test leader plays different excitation sounds at different frequencies and levels, where the end user signals to the test leader (typically by pushing a button) if he/she hear the test sounds.

In one embodiment, an automatic procedure of such a hearing test is built into an app and/or computer software, so that it is possible to make such a test by the end user alone.

However, even in an app/software-controlled hearing test, the end user would still need to react to the test sounds, if the end user didn't interact in the correct way needed, the hearing test and the fitting session would fail.

In one embodiment, sensors e.g., EEG sensors, are used, as part of the hearing aid earmolds or simple add-on sensors (close to the ear-region) to the hearing aids, to sense the reaction of the user and to perform a hearing test without the need of end user interaction.

In one embodiment, the hearing device, connected to a smart phone app, is configured such that test sounds are correctly played. The EEG sensor and/or other sensor signals are picked up and processed automatically to ensure a correct hearing test without otherwise interactions from the end user, except that the end user has to put on the hearing device (including additional the sensors) and start the measurement process.

Measurement equipment for picking up scalp EEG signals without the need of end user reactions are known in the art.

In one embodiment a small-scaled measurement equipment using built-in or add-on EEG sensor to hearing devices is used as part of the provided fitting method.

In one embodiment, while performing the hearing test, the already available test sounds is used to assessing the probability of correct the physical fit and/the feedback risk. This is independent of if the EEG or other sensor signals are used for the hearing test assessment.

Physical Fit and Feedback Risk Assessment

Another aspect to be addressed in a remote and/or self-fitting situation is the correct physical fit of the hearing device. The physical fit involves a few important aspects, such as selection of correct earpieces, correct placement of these, and assessment of feedback risk based on the placement of the hearing device. All these are individual to each end user.

In a traditional fitting, the HCP would initially ensure the correct physical fit and then instruct the end user on how to re-insert the hearing device and/or earpieces for this correct physical fit. This must be addressed differently in a remote or self-fitting session.

In one embodiment, an example method is provided comprising the below mentioned steps (some steps are interchangeable and optional etc.), which can be carried out using a smart phone app:

- Step 1: Recommendation of an earpiece is presented and based on the hearing test and other available personal data, such as age, lifestyle, experience with hearing aid etc.
- Step 2: Instruct the user how to place the hearing device and the earpiece with a video clip or animation shown in the app.
- Step 3: Conduct some acoustic feedback measurements in the background.
- Step 4: Instruct the end user to take photo(s) of the ear region including the inserted hearing device using the smart phone camera with auto focus and auto shutter functions.
- Step 5: Using the data from step 3 and step 4 (jointly) to assess the probability of a correct physical fit of the hearing device and to assess feedback risk.
- Step 6: If necessary, instruct the end-user to adjust the hearing device, including how, e.g., deeper insertion, tilting etc.
- Step 7: If necessary, inform the end user that there is a feedback and/or gain problem, and provide instructions so that the end-user can choose how to mitigate the problem. Another option provided to the end-user can be that the system takes care of the problem automatically, based on some predefined strategies.
- Step 8: If necessary, instruct the user to change to another hearing device or earpiece. In such a case, repeat the steps 2-8.
- Step 9: If the assessment (step 5) provides a positive result, inform the end user of correct physical fit of hearing device and earpiece To assess the physical fit with the use of photos taken in step 4 can be based on traditional model-based methods, and/or artificial intelligence, AI, using deep neural network approaches.

FIG. 1 shows a flowchart illustrating a method of fitting of a hearing device 1 without a Hearing care professional's (HCP) involvement, the hearing device comprising an input transducer 2 for picking up sound in the environment of a user 10 and providing an electric input signal, and an output transducer 3 for providing output stimuli perceivable to the user as sound based on a processed version of said electric input signal. The method comprising:

- executing S1 a fitting application on a graphical user interface, GUI, of an external device in communication with the hearing device 1,
- detecting S2 by measuring reactions of the user to the picked-up sound,
- performing acoustic feedback measurements S3 as a background process without a user's involvement,
- assessing S4 the probability of a correct physical fit based on the position of the inserted hearing device, assessing feedback risk S5 based on the correct physical fit assessment and the acoustic feedback measurements, and fine tuning S6 fitting parameter of the hearing device based on the result of at least one of the detected reactions of the user, acoustic feedback measurements and saved, within the fitting application, personal information of the user, wherein steps S1 to S6 are configured to be automatically performed as background processes.

Figure 2:
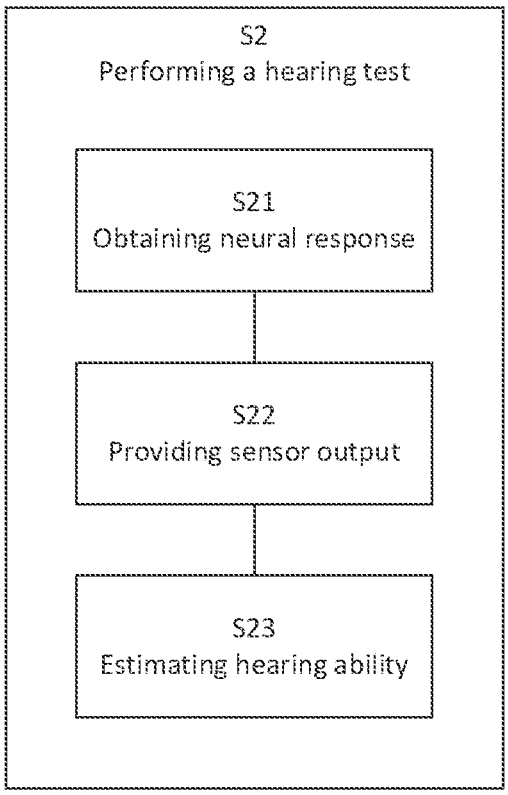
FIG. 2 shows a flowchart of the method according to the present disclosure.
Figure 3:
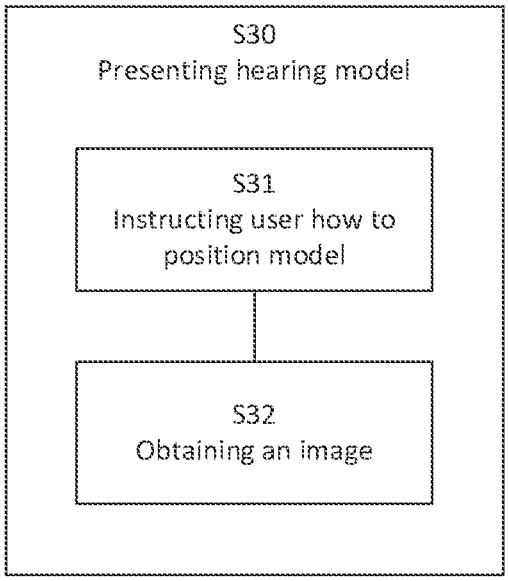
FIG. 3 shows a flowchart of the method according to the present disclosure.

FIG. 2 shows a flowchart illustrating an embodiment of the method wherein the step of detecting by measuring reactions S2 comprises performing a hearing test S21, within the fitting application, for estimating a hearing ability of a user of the hearing device. In an aspect, the step of performing a hearing test S21 comprises obtaining S211 a neural response to the hearing test by a sensor of the hearing device, providing S212 a sensor output based on the neural response, estimating S213 hearing ability of the user based on the sensor output and the microphone output of the hearing device, and wherein the step of fine tuning S6 fitting parameter of the hearing device is based on the estimated hearing ability. In an aspect, the step of detecting by measuring reactions S2 comprises presenting S214, as shown in FIG. 3, within the fitting application, a hearing device model based on the result of the performed hearing test application and saved, within the fitting application, personal information of the user, and instructing the user S2141, within the fitting application, how to position the presented hearing device model in the ear of the user, and obtaining S2142 an image of the ear region including the inserted hearing device by using a camera unit of the external device.

In an embodiment, the step of assessment of the probability of correct physical fit S4 comprising if the assessment provides a positive result, informing S41 the user, via the fitting application, of correct physical fit of the hearing device, or if the assessment provides a negative result, informing S41 the user, via the fitting application, of incorrect physical fit of the hearing device and instruct S42 user to adjust hearing device.

In an embodiment, the method comprises automatically, if the assessment of feedback risk S5 provides a negative result which is based on an acoustic feedback and/or gain problem, mitigating the assessed problem based on predefined strategies.

In an embodiment, the method comprises, if the assessment of feedback risk S5 provides a negative result which is based on an acoustic feedback and/or gain problem, informing the user, within the fitting application, of the problem, and providing instructions to the user, within the fitting application, of how to mitigate the problem.

Figure 4:
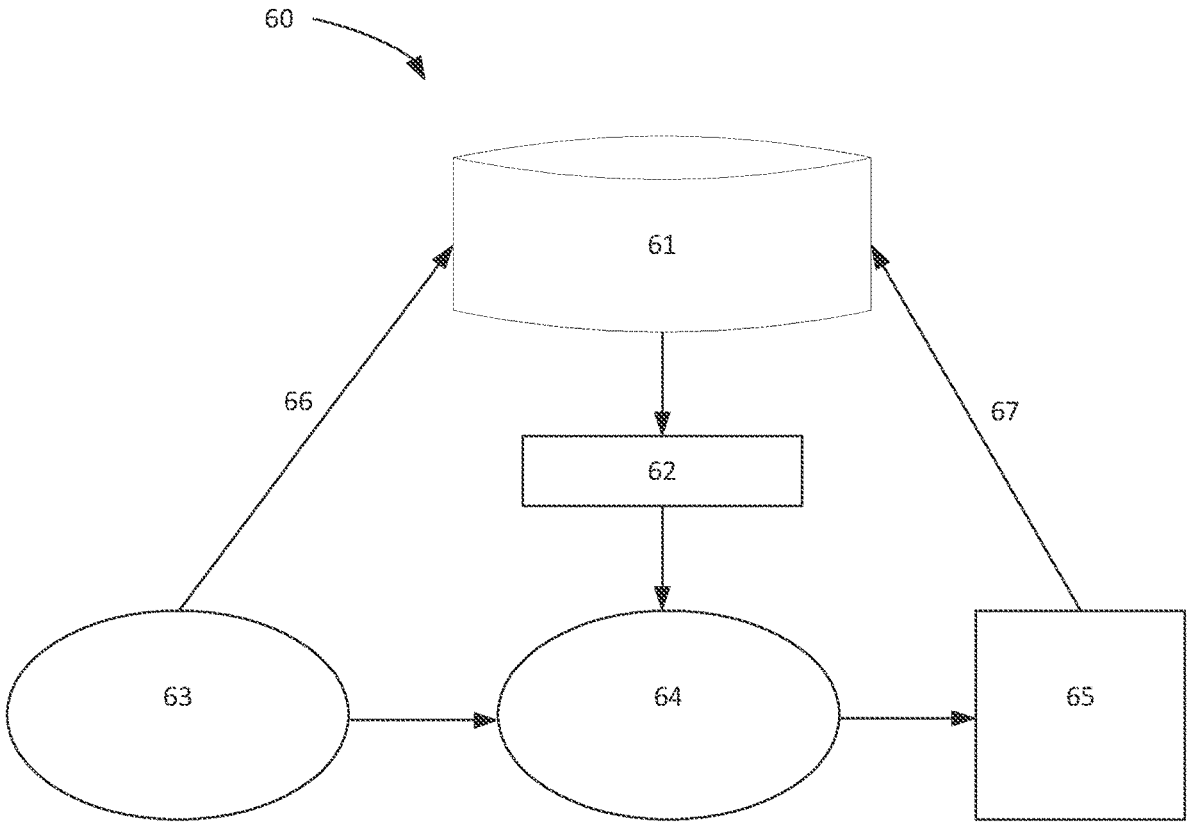
FIG. 4 shows a flowchart of the method based on AI according to the present disclosure.

In an embodiment, already available fitting data and personal data from a database 61 can be used to "control/direct" the current remote or self-fitting session and thereby use the artificial intelligence 62 to compensate for the missing HCP (and his/her experience) in a remote and/or self-fitting session, as shown in FIG. 4. This can also be carried out in an app, which is connected to the database 61 in the "cloud".

A method that allows remote and/or automatic fitting using artificial intelligence (AI) is provided, as shown in FIG. 4. Personal data 63, such as age, gender, audiogram, living style, typical daily activities, professions, etc., is used as the inputs to a high-quality AI model 64, which makes a recommendation of fitting parameters to a hearing device. The training of the model 64 is based on the data from successful fitting sessions including personal input data 66 and final fitting parameters 67.

Some examples of potential benefits of using the AI based remote/automatic fitting:

Improved general fitting incl. insertion gain prescription and appropriate parameter settings to different features such as hearing noise reduction and feedback management Deliver individually optimized fitting to the end-users Require less knowledge/effort from the HCPs to obtain a well-functioning basic fitting Allows the hearing instruments to be directly sold to end-users, as the fitting process is fully automatic and can be done by end-users in most cases (HCP specialist can still help the end-users who might not be able to do a satisfactory fitting)

It is known that the fitting process is somehow based on simple personal data such as age, gender, and audiogram, even though more personal data can be collected during/before the fitting session, they are not directly used in the fitting session. During a fitting session today, based on the audiogram, a target gain is calculated and default settings for additional features such as noise reduction, feedback management are applied to all users. All these (target gain, noise reduction, feedback management) are modelled by audiologists and engineers (high demand on resources). The HCPs can then change these default settings based on their own experience and/or user's need/feedback. Especially the last part requires a lot of knowledge/effort from the HCPs and expensive training has to be provided by the manufactures; many times, the fitting is not optimal for the end-users, even though experienced HCPs spend a lot of effort.

In an embodiment, artificial intelligence (AI) is used, more detailed personal data 63 and the corresponding successful fitting data 65, from the past, are collected 66, 67 into a central database 61, which requires some kind of logging functionality from each fitting session, by using an AI advanced model 64 which is trained, and much higher quality fitting recommendations are provided.

The high-quality fitting recommendations are made based on end-user's self-reported living style, daily activities, and profession etc. in addition to the simple data such as age, gender, and audiogram. As an example, the settings to different features are set automatically, e.g., for a musician the feedback management system will be by default on the sound quality mode. i.e., allowing more feedback occurrence/severity while preserving maximally sound naturalness, and for a factory worker in a noisy working environment the noise reduction system is by default on the aggressive noise reduction mode. All settings can then be changed/fine-tuned by the HCP if necessary.

FIG. 4 shows a flowchart illustrating an embodiment of the method wherein the step of assessing the probability of a correct physical fit S4 comprises applying a learning machine 60 for assessing the probability of a correct physical fit.

In an embodiment, the step of assessing feedback risk S5 comprising applying a learning machine 60 for assessing the feedback risk.

In an embodiment, the step of applying a learning machine 60 comprises collecting personal data 63 and corresponding fitting data 65 and saving in a central database 61 and using artificial intelligence (AI) 62 for training a model 64 for fitting the hearing device 1 to the user's hearing abilities.

This disclosure further relates to the acoustic feedback problem, particularly in hearing aids. Adaptive filter in a system identification setup is a state-of-the-art solution to minimize the effect of the feedback problem. However, the adaptive filter approach in a hearing aid can very easily suffer from the biased estimation problem because it is operating in a closed loop. The biased estimation problem is the major problem that prevents a good feedback cancellation performance.

Different aspects around ear have influences on the feedback path, such as the ear canal depth, the ear canal diameter (varying over the ear canal), the size and rotation angle of pinna, and the hearing aid including earplug or domes which are located close to the ear etc.

Figure 5:
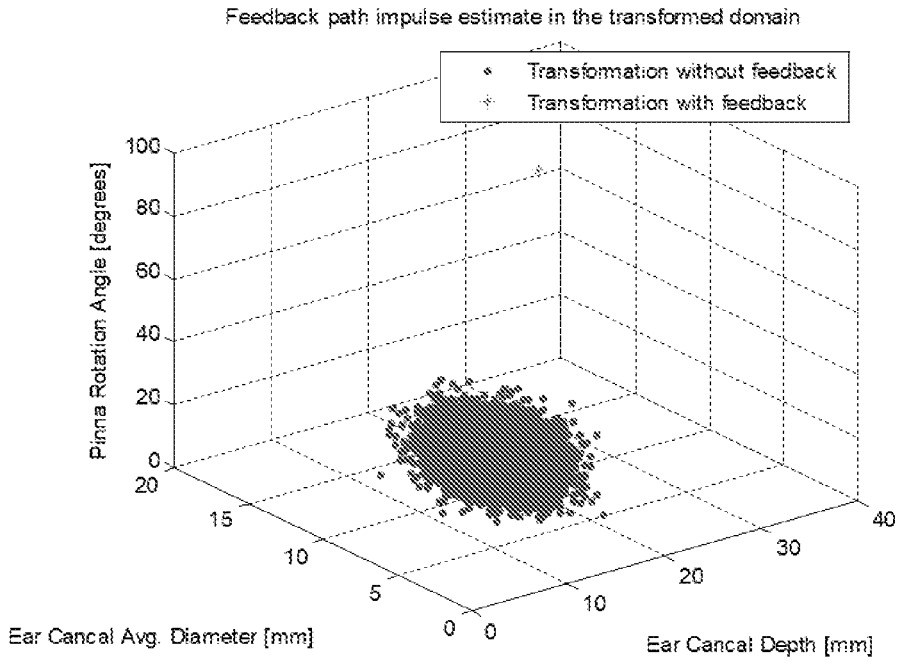
FIG. 5 shows an example of transforming the acoustic feedback path into a high-dimensional feature space.

Hence, given a feedback path estimate, it is possible to transform feedback path estimate to a high-dimension space with the feedback parameters as basis. This is illustrated in FIG. 5. In the case where there is a biased estimation problem, the mapping to this high dimensional space would give an unexpected result because the acoustic feedback does not fit into any dimensions, meaning that the mapped point into this space is out of its normal range.

FIG. 5 shows an example of transforming the acoustic feedback path into a high-dimensional feature space (only 3 dimensions showed) based on ear acoustics such as the size of ear canal and pinna. The dots indicate the transformed values when a valid acoustic feedback path estimate is transformed into this feature space; the transformed value will somehow be located in a certain area, shown as a cloud of dots in FIG. 5, determined by the ear acoustics. However, if the acoustic feedback path estimate is corrupted by the biased estimation, it will somehow deviate from its normal position (the cloud of dots), as indicated by the star in FIG. 5.

Once an outlier, the star in FIG. 5, have been discovered, two actions could be performed:

1. The adaptation can be stopped, which reduces the hearing aid gain and prevents the biased estimation and howling, or
2. The advanced version: the knowledge of the acoustics of the ear is used and the constrain of one or more dimensions of the estimates is used to limit/eliminate the impact on the biased estimation problem.

In one embodiment, the above provided model is used for head-related transfer functions (hrtf).

In an embodiment, the acoustic feedback path transformed into a high dimensional feature space with surrounding ear acoustics as basis is technically feasible.

The most significant advantage in combat the biased estimation problem is that no artefact is introduced in contrast to existing solutions such as frequency shift, probe noise injection etc.

Figure 6:
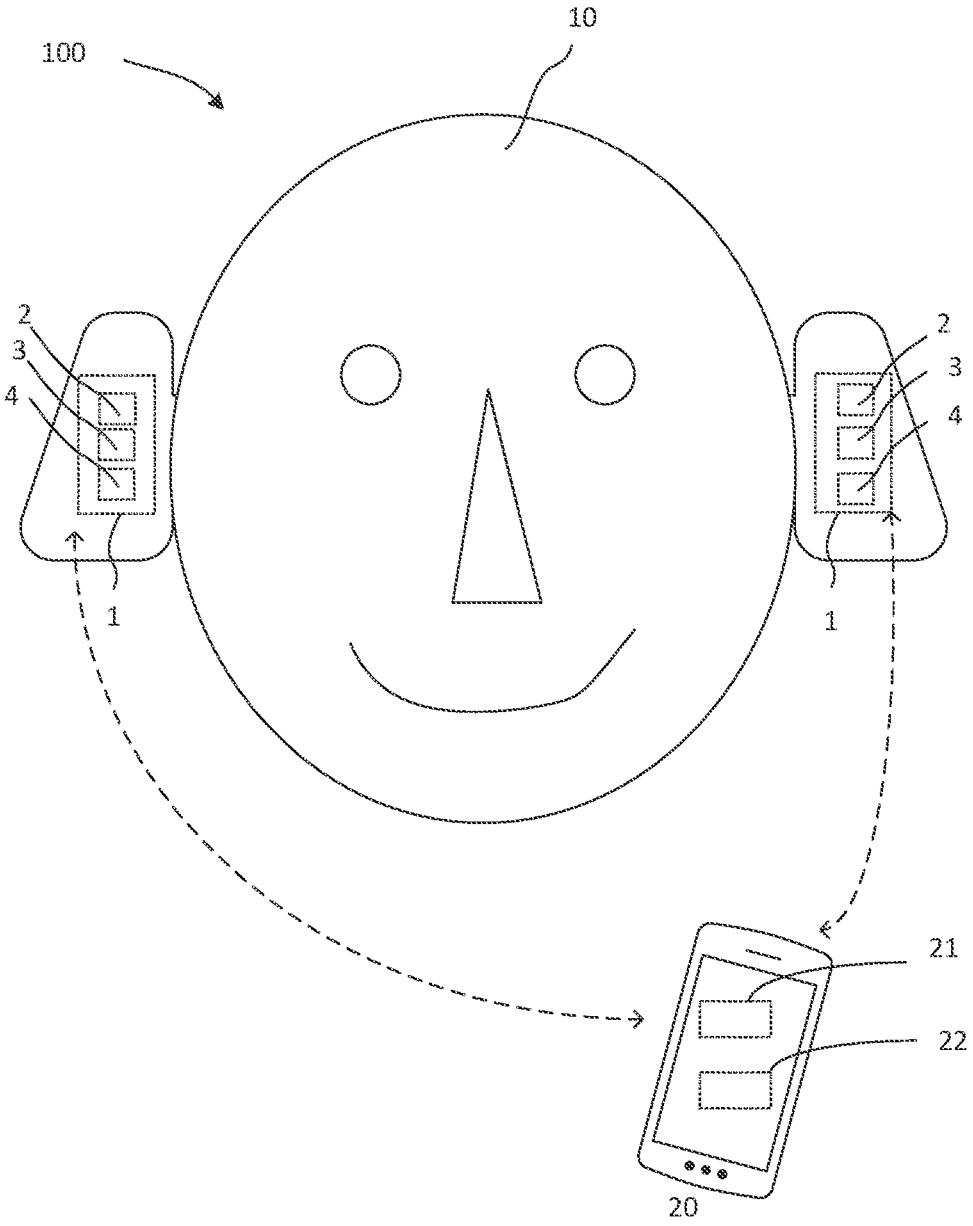
FIG. 6 illustrates a hearing system according to the present disclosure.

FIG. 6 illustrates a hearing system 100 comprising a hearing device 1 adapted for being programmed according to detected by measuring of reactions of a hearing device user 10. The hearing device comprises an input transducer 2 for picking up sound in the environment of the user and providing an electric input signal, an output transducer 3 for providing output stimuli perceivable to the user as sound based on a processed version of said electric input signal and a configurable hearing device processor 4 for processing said electric input signal and providing said processed version of said electric input signal. The hearing system 100 further comprising a graphical user interface, GUI, allowing the user to interact with the hearing device, wherein the hearing system is configured to execute the method of as described in the disclosure.

In an embodiment, the hearing system 100 comprises a communication device 20, such as a smartphone, mobile communication device, computer, laptop etc., which comprises a processor 21 for executing program code of a fitting system for the hearing device 1, and a programming interface 22 between the hearing device 1 and the communication device 20, wherein the programming interface is configured to allow the exchange of data between the hearing device and the communication device. In an aspect, the programming interface 22 is configured to establish a wired or wireless communication link between the hearing device 1 and the communication device 20.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e., to have the meaning "at least one"), unless expressly stated otherwise. It will be further understood that the terms "includes." "comprises," "including." and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element, but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method are not limited to the exact order stated herein, unless expressly stated otherwise.

It should be appreciated that reference throughout this specification to "one embodiment" or "an embodiment" or "an aspect" or features included as "may" means that a particular feature, structure, or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A method of fitting of a hearing device without a Hearing care professional's (HCP) involvement, the hearing device comprising an input transducer for picking up sound in an environment of a user and providing an electric input signal, and an output transducer for providing output stimuli perceivable to the user as sound based on a processed version of said electric input signal, the method comprising, S1—executing a fitting application on a graphical user interface (GUI) of an external device in communication with the hearing device, S2—detecting, by measuring, reactions of the user to the picked-up sound, S3—performing acoustic feedback measurements as a background process without a user's involvement, S4—assessing the probability of a correct physical fit based on the position of the inserted hearing device, S5—assessing feedback risk based on the correct physical fit assessment and the acoustic feedback measurements, and S6—fine tuning a fitting parameter of the hearing device based on the result of at least one of: a) the detected reactions of the user, b) acoustic feedback measurements, and c) saved, within the fitting application, personal information of the user, wherein steps S1 to S6 are configured to be automatically performed as background processes.

2. The method according to claim 1, wherein the detecting by measuring, reactions comprises:

performing a hearing test, within the fitting application, for estimating a hearing ability of a user of the hearing device.

3. The method according to claim 2, wherein the step of performing a hearing test comprises:

obtaining a neural response to the hearing test by a sensor of the hearing device, providing a sensor output based on the neural response, and estimating the hearing ability of the user based on the sensor output and a microphone output of the hearing device, wherein fine tuning the fitting parameter of the hearing device is based on the estimated hearing ability.

4. The method according to claim 2, wherein the method comprises:

presenting, within the fitting application, a hearing device model based on the result of the performed hearing test application and saved, within the fitting application, personal information of the user, and instructing the user, within the fitting application, how to position the presented heating device model in the ear of the user, and obtaining an image of the ear region including the inserted hearing device by using a camera unit of the external device.

5. The method according to claim 1, wherein the step of assessment of the probability of correct physical fit comprises:

if the assessment provides a positive result, informing the user, via the fitting application, of correct physical fit of the hearing device, or if the assessment provides a negative result, informing the user, via the fitting application, of incorrect physical fit of the hearing device and instructing the user to adjust heating device.

6. The method according to claim 1, wherein the method comprises:

automatically, if the assessment of feedback risk provides a negative result which is based on an acoustic feedback and/or gain problem, mitigating the assessed problem based on predefined strategies.

7. The method according to claim 1, wherein the method comprises:

if the assessment of feedback risk provides a negative result which is based on an acoustic feedback and/or gain problem, informing the user, within the fitting application, of the problem, and providing instructions to the user, within the fitting application, of how to mitigate the problem.

8. The method according to claim 1, wherein the step of assessing the probability of a correct physical fit comprises applying machine learning for assessing the probability of a correct physical fit.

9. The method according to claim 1, wherein the step of assessing feedback risk comprises applying machine learning for assessing the feedback risk.

10. The method according to claim 8, wherein the step of applying machine learning comprises:

collecting personal data and corresponding fitting data and saving in a central database, and using artificial intelligence for training a model for fitting the hearing device to the user's hearing abilities.

11. The method according to claim 1, wherein said hearing device is constituted by or comprises a hearing aid.

12. A hearing system comprising a hearing device adapted for being programmed to detect, by measuring, reactions of a hearing device user, the hearing device comprising an input transducer for picking up sound in the environment of the user and providing an electric input signal, an output transducer for providing output stimuli perceivable to the user as sound based on a processed version of said electric input signal, a configurable hearing device processor for processing said electric input signal and providing said processed version of said electric input signal, and the hearing system further comprising a graphical user interface (GUI) allowing the user to interact with the hearing device, wherein the hearing system is configured to execute the method of claim 1.

13. The hearing system according to claim 12, comprising a communication device comprising a processor for executing program code of a fitting system for the hearing device, and a programming interface between the hearing device and the communication device, wherein the programming interface is configured to allow the exchange of data between the hearing device and the communication device.

14. The hearing system according to claim 13, wherein said programming interface is configured to establish a wired or wireless communication link between the hearing device and the communication device.

15. A hearing system according to claim 13, wherein said hearing device is constituted by or comprises a hearing aid.

16. The method according to claim 3, wherein the method comprises:

presenting, within the fitting application, a hearing device model based on the result of the performed hearing test application and saved, within the fitting application, personal information of the user, instructing the user, within the fitting application, how to position the presented hearing device model in the ear of the user, and obtaining an image of the ear region including the inserted hearing device by using a camera unit of the external device.

17. The method according to claim 2, wherein the step of assessing the probability of a correct physical fit comprises applying machine learning for assessing the probability of a correct physical fit.

18. The method according to claim 3, wherein the step of assessing the probability of a correct physical fit comprises applying machine learning for assessing the probability of a correct physical fit.

19. The method according to claim 4, wherein the step of assessing the probability of a correct physical fit comprises applying machine learning for assessing the probability of a correct physical fit.

20. The method according to claim 5, wherein the step of assessing the probability of a correct physical fit comprises applying machine learning for assessing the probability of a correct physical fit.

* * * * *